US007195349B2

(12) United States Patent
Uji et al.

(10) Patent No.: US 7,195,349 B2
(45) Date of Patent: Mar. 27, 2007

(54) INK JET RECORDING APPARATUS

(75) Inventors: Ayako Uji, Tokyo (JP); Noribumi Koitabashi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 194 days.

(21) Appl. No.: 11/008,506

(22) Filed: Dec. 8, 2004

(65) Prior Publication Data

US 2005/0128275 A1 Jun. 16, 2005

(30) Foreign Application Priority Data

Dec. 15, 2003 (JP) ..... 2003-417370
Oct. 8, 2004 (JP) ..... 2004-296683

(51) Int. Cl.
*B41J 2/01* (2006.01)
*B41J 13/08* (2006.01)

(52) U.S. Cl. ..... 347/104; 400/635

(58) Field of Classification Search ..... None
See application file for complete search history.

(56) References Cited

U.S. PATENT DOCUMENTS 5,635,969 A * 6/1997 Allen ..... 347/96
6,419,411 B1 7/2002 Tanno
6,739,714 B2 * 5/2004 Saijo ..... 347/96
6,945,628 B2 * 9/2005 Koitabashi et al. ..... 347/34

FOREIGN PATENT DOCUMENTS

JP 06-166173 A 6/1994

* cited by examiner

*Primary Examiner*—Daniel J. Colilla
(74) *Attorney, Agent, or Firm*—Canon U.S.A. IP Div

(57) ABSTRACT

An ink jet recording apparatus minimizing adhesion of ink mist to a recording medium due to electrostatic attraction of a belt conveying the recording medium. The apparatus includes a liquid applying device applying a processing liquid to a position on the recording medium corresponding to an attracting-force generating device provided on the conveying belt. The apparatus discharges the processing liquid to the position before the ink is discharged on the recording medium. Since moisture of the processing liquid reduces surface charges of the recording medium, the amount of ink mist adhering to the recording medium can be reduced.

6 Claims, 9 Drawing Sheets

INK JET RECORDING APPARATUS

BACKGROUND OF THE INVENTION

1. Field of the Invention

The present invention relates to an ink jet recording apparatus that performs recording by discharging ink to a recording medium such as a recording sheet, and more specifically, it relates to an ink jet recording apparatus that reduces adhesion of ink mist to the recording medium, the ink mist being generated in the recording.

2. Description of the Related Art

In an ink jet recording apparatus, when ink is discharged to a recording medium to record an image, in addition to normal ink drops, minute ink drops called satellites are generated. In addition, the discharged normal ink drops bounce off the recording medium to generate other minute ink drops. These minute ink drops become an ink mist and are scattered and suspended in the recording apparatus. The mist contaminates components of the apparatus. If the mist adheres to a part on which a recording medium is conveyed, such as a paper guide, the conveyed recording medium is smudged. If the mist adheres to an optical sensor, defective detection is caused. If the mist adheres to a guide member for a carriage of a serial recording apparatus, increased resistance to the carriage causes defective operation.

Hitherto, in order to prevent the ink mist from being generated or adhering to specific parts of the apparatus, various constitutions have been proposed. For example, by modifying a recording head, which discharges ink, the satellites are prevented from being generated, and therefore the ink mist is prevented from being generated. Alternatively, by introducing air into the space between the recording head and the recording medium with a fan, the ink mist is prevented from adhering to the recording medium (see, for example, Japanese Patent Laid-Open No. 06-166173).

A so-called full line type ink jet printer uses a recording head in which many ink-discharging nozzles are arranged in the width direction of the conveyed recording medium. The full line type ink jet printer has various advantages such as high-speed recording. The full line type ink jet printer generally uses an electrostatic conveyer belt as a recording-medium conveying mechanism. The conveyer belt holds a recording medium with electrostatic attracting force. More specifically, potential difference is generated between an electrode plate and a ground plate embedded in the conveyer belt, thereby generating an electric field. The electric field dielectrically polarizes the recording medium. In this way, the recording medium and the conveyer belt have charges of opposite polarity. Due to the electrostatic force, the recording medium is attracted to the conveyer belt. By using such a method for conveying, the recording medium is fastened to the conveyer belt, and defects in the recorded image and jamming are reduced (see, for example, Japanese Patent Laid-Open No. 2000-095374, corresponding to U.S. Pat. No. 6,419,411).

In a recording apparatus using the above electrostatic conveyer belt, if a recording head preventing the ink mist from being generated is used, or if a mechanism, such as a fan, preventing the ink mist from adhering to specific parts is used, the problems concerning ink mist adhesion can be solved to some extent. However, due to the electric field generated on the conveyer belt, the recording medium itself attracts the ink mist. Even if a recording head preventing the ink mist from being generated and a mechanism preventing the ink mist from adhering to specific parts are used, a little ink mist is still generated and adheres to the recording medium, thereby deteriorating recording quality. If neither a recording head preventing the ink mist from being generated nor a mechanism preventing the ink mist from adhering to specific parts is used, the problem of the ink mist adhering to the recording medium due to the electric field becomes noticeable.

SUMMARY OF THE INVENTION

The present invention is directed to an ink jet recording apparatus that can reduce adhesion of ink mist to a recording medium caused by electrostatic attraction of a conveyer belt.

In one aspect of the present invention, an ink jet recording apparatus operable to record images on a recording medium with ink, includes: a conveyer belt operable to convey the recording medium thereon; an attracting-force generating device including an electrode plate provided on the conveyor belt and operable to generate a force to attract the recording medium to the conveyer belt; a recording head operable to discharge the ink onto the recording medium to record images thereon; and a liquid applying device applying a liquid different from the ink to at least a position on the recording medium corresponding to the attracting-force generating device. The liquid applying device applies the liquid to the recording medium before the recording head discharges the ink onto the recording medium.

In another aspect of the present invention, an ink jet recording apparatus operable to record images on a recording medium with ink, includes: a conveyer belt operable to convey the recording medium thereon; a recording head operable to discharge the ink onto the recording medium to record images thereon; a liquid discharging head configured to discharge a liquid different from the ink onto the recording medium; a duty detecting device detecting a recording duty of regions on the recording medium based on recording data; and a controlling device controlling the liquid discharging head to discharge the liquid to a region on the recording medium adjacent to a region on the recording medium having a recording duty higher than a predetermined duty value.

In yet another aspect of the present invention, an ink jet recording apparatus operable to record images on a recording medium with ink, includes: a conveyer belt operable to electrostatically attract the recording medium thereon and to convey the recording medium; a recording head operable to discharge the ink onto a first position on the recording medium to record images thereon; a liquid applying device applying a liquid different from the ink to the recording medium; and a controlling device controlling the liquid applying device to discharge the liquid to a second position on the recording medium.

In yet still another aspect of the present invention, an ink jet recording apparatus operable to record images on a recording medium with ink, includes: a conveyer belt operable to convey the recording medium thereon; an attracting-force generating device facilitating attracting the recording medium to the conveyer belt; a recording head operable to discharge the ink to the recording medium to record images thereon; and a liquid applying device applying a liquid different from the ink to at least a position on the recording medium corresponding to the attracting-force generating device.

Due to the electric field for electrostatic attraction, charges are generated on the surface of the recording medium. When ink is discharged, ink mist having opposite polarity from the charges is generated. The present invention reduces the charges with liquid different from the ink.

Consequently, the present invention reduces the amount of the ink mist adhering to the surface of the recording medium.

Further features and advantages of the present invention will become apparent from the following description of the embodiments (with reference to the attached drawings).

DESCRIPTION OF THE EMBODIMENTS

The embodiments of the present invention will now be described with reference to the drawings.

Figure 1:
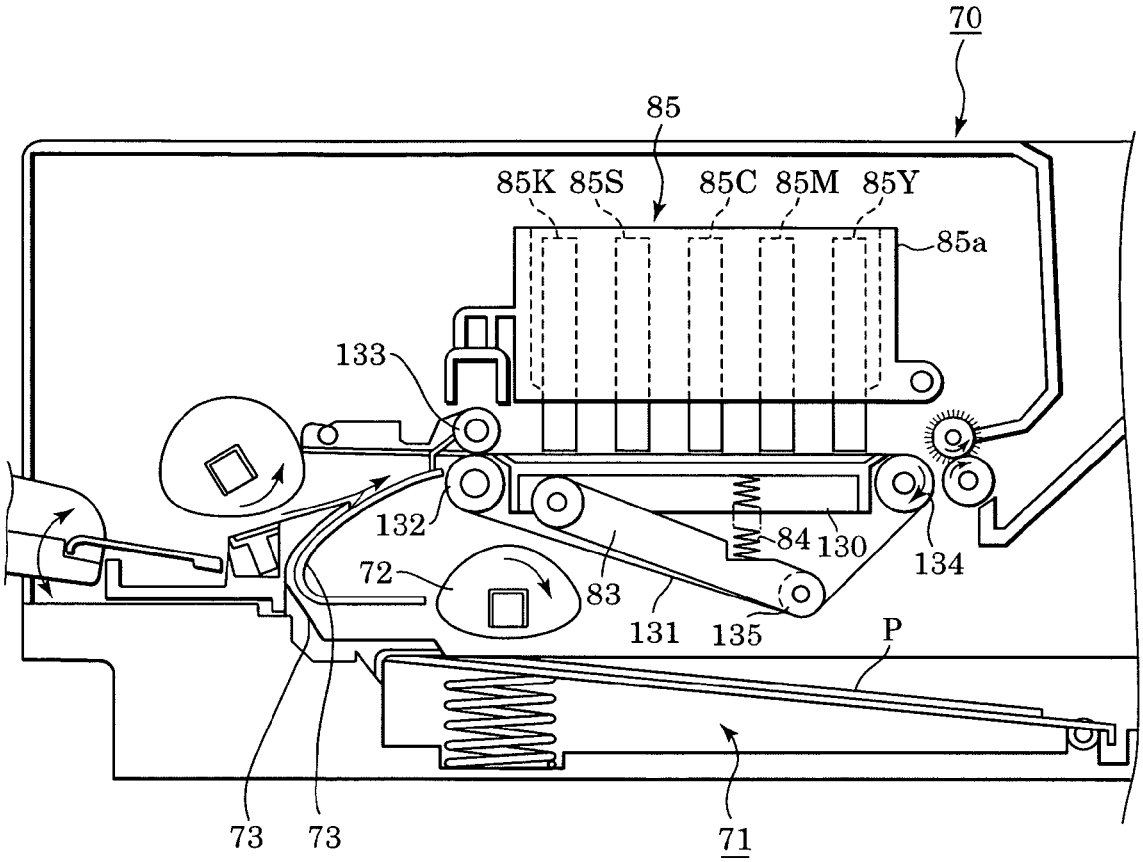
FIG. 1 shows the overall structure of an ink jet printer according to an embodiment of the present invention viewed from the direction perpendicular to the direction in which a recording medium is conveyed.

FIG. 1 shows the overall structure of an ink jet printer 70 according to an embodiment of the present invention viewed from the direction perpendicular to the direction in which a recording medium is conveyed. In FIG. 1, the scale of a recording-medium feeding mechanism is different from that of the other mechanisms.

In FIG. 1, in a feeding section 71, a recording medium P is mounted on a pressing plate, which is urged upward by a spring. When the recording medium P is fed, the recording medium P is pressed toward a feeding roller 72 by the above urging force, and the feeding roller 72 rotates. In this way, the recording medium P is fed sheet by sheet. The fed recording medium P is guided to a lower conveyance guide 73, and is then guided onto a conveyer belt 131 between a driven roller 132 and a pinch roller 133. The conveyer belt 131 is extended by a driving roller 134, the driven roller 132, and a tension roller 135. The conveyer belt 131 is circulated by the driving roller 134, which is driven by a driver (not shown) such as a pulse motor. As described below with reference to FIG. 3, this conveyer belt 131 holds the recording medium P with electrostatic force and conveys it to the starting position above a platen 130. An arm 83 is pivoted to the platen 130 so as to swing freely, and the free end of the arm 83 is provided with the tension roller 135. Urged downward by a spring 84, the arm 83 applies tension to the conveyer belt 131.

A head holder 85*a* is provided above the conveyer belt 131 moving on the platen 130. The head holder 85*a* holds recording heads 85 for discharging ink, that is to say, a head 85K discharging black (K) ink, a head 85C discharging cyan (C) ink, a head 85M discharging magenta (M) ink, and a head 85Y discharging yellow (Y) ink. In addition, the head holder 85*a* holds another head 85S (liquid discharging head) for discharging liquid (processing liquid) that is transparent or extremely pale in color and is for improving fixability of the black ink. These heads 85K, 85S, 85C, 85M, and 85Y are arranged at predetermined intervals in this order in the direction in which the recording medium P is conveyed.

As the processing liquid, liquid reacting with the black ink is used, or liquid improving permeation rate of the black ink is used. Here, "react" means to insolubilize or aggregate the color material in the ink. In the case where the color material is dye, an ingredient insolubilizing the dye is included in the processing liquid. In the case where the color material is a pigment, an ingredient aggregating the pigment is included in the processing liquid. In order to improve the permeation rate of the ink, the permeability of the processing liquid is made higher than that of the ink. In order to obtain a high permeability of the processing liquid, the processing liquid includes a surface active agent.

Figure 2:
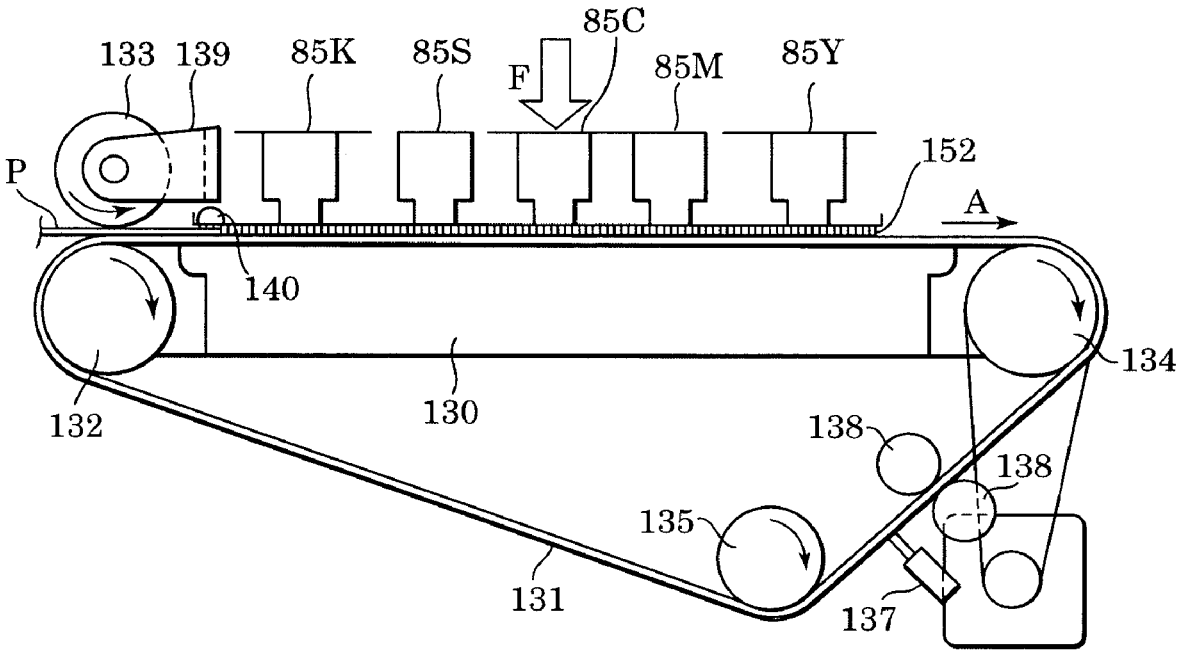
FIG. 2 shows the details of the conveyer belt and the mechanism driving same in FIG. 1.
Figure 3:
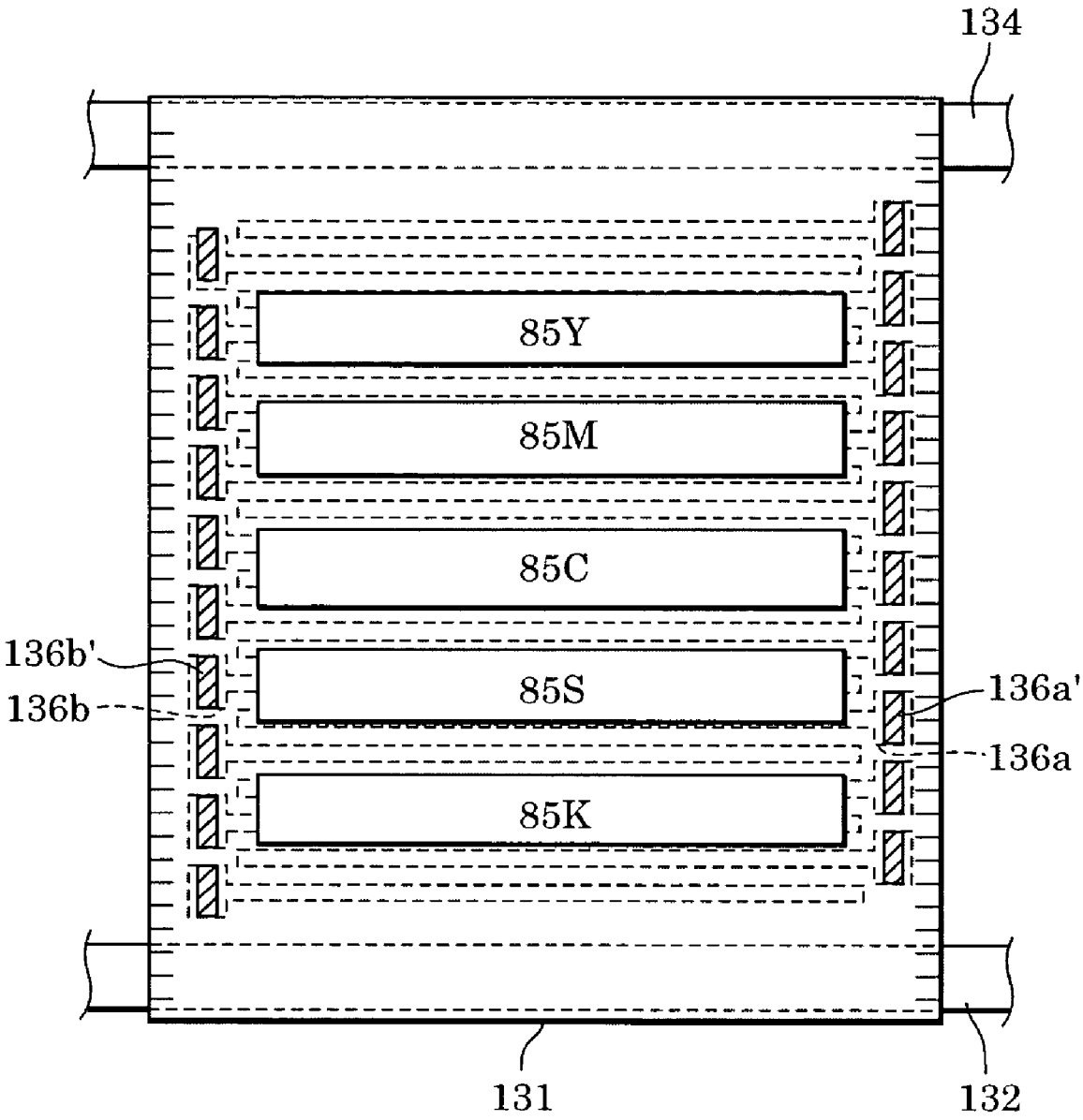
FIG. 3 is a schematic view showing the structure for generating electrostatic attracting force on the conveyer belt, the structure being viewed from the direction of arrow F in FIG. 2.

FIG. 2 shows the details of the conveyer belt 131 and the mechanism driving the same in FIG. 1. FIG. 3 is a schematic view showing the structure for generating electrostatic attracting force on the conveyer belt 131, the structure being viewed from the direction of arrow F in FIG. 2.

In FIG. 2, the conveyer belt 131 is an endless belt having a thickness of about 0.1 to 0.2 mm, and formed of a synthetic resin such as polyethylene or polycarbonate. The conveyer belt 131 is provided with an attracting-force generating mechanism, which will be described below with reference to FIGS. 3 and 9. An electrical feeding brush 152 is in contact with electrode terminals constituting the mechanism. By applying a voltage of about 0.5 to 10 kV to the brush 152, attracting force can be generated on the conveyer belt 131 under the recording head 85. Incidentally, the electrical feeding brush 152 is connected to a high-voltage power supply (not shown) generating a predetermined high voltage.

The recording medium P is conveyed between the driven roller 132 and the pinch roller 133. The recording medium P is pressed to the conveyer belt 131 by a holding roller 140, which is provided in the vicinity of the driven roller 132 and the pinch roller 133. This holding roller 140 is supported by a roller supporting member 139. The roller supporting member 139 is rotatable around the shaft of the pinch roller 133. The holding roller 140 is urged towards the conveyer belt 131 by an urging device (not shown). The conveyer belt 131 is held between a cleaning roller pair 138 and pressed by the same. Rollers that constitute the cleaning roller pair 138 are formed of a sponge. The sponge can absorb the ink and has continuous pores. In order to prevent deterioration, each pore has a small diameter (about 10 to 30 μm). Therefore, the cleaning roller pair 138 can remove dirt, such as ink, adhering to the conveyer belt 131. The conveyer belt 131 is cleaned by this cleaning roller pair 138, and is then charge-eliminated by a charge eliminating brush 137 as a charge eliminating device.

Figure 9:
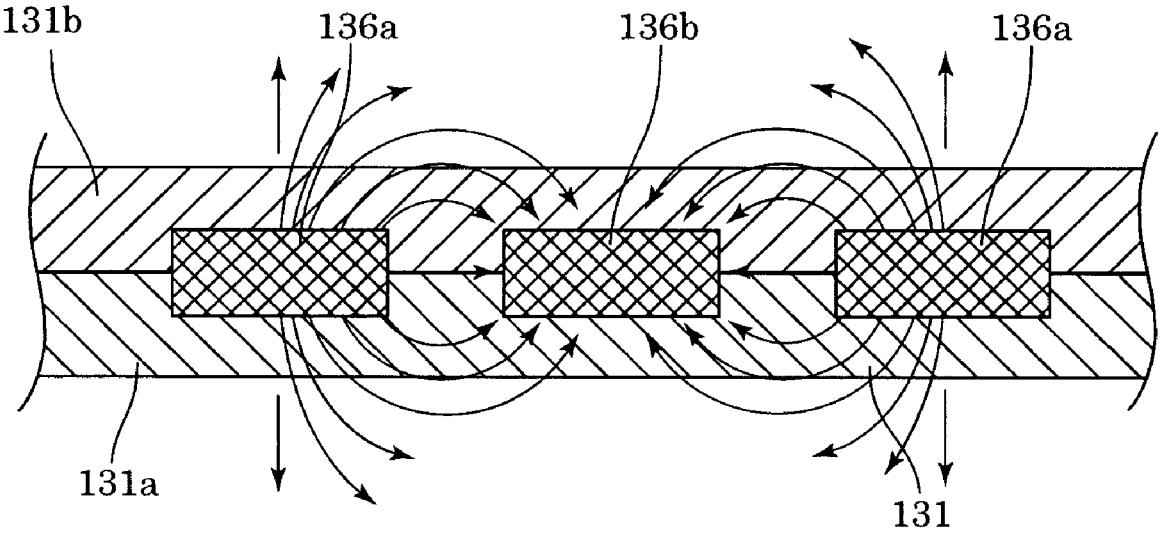
FIG. 9 is a schematic view showing the electric lines of force generated between an electrode plate and a ground plate provided in the conveyer belt.

As shown in FIG. 3, the attracting-force generating mechanism of this embodiment is composed of electrode plates 136*a* and ground plates 136*b* made of conductive metal and provided in the conveyer belt 131. More specifically, as shown in FIG. 9, the electrode plates 136*a* and the ground plates 136*b* are sandwiched between a base layer 131*a* and a surface layer 131*b*. The base layer 131*a* and the surface layer 131*b* are formed of a synthetic resin such as polyethylene or polycarbonate. In addition, as shown in FIG. 3, the electrode plates 136*a* and the ground plates 136*b* are arranged alternately in the direction in which the conveyer belt 131 moves. Each electrode plate 136*a* has a terminal 136*a'* at the right end of the conveyer belt 131. Each ground plate 136*b* has a terminal 136*b*' at the left end of the conveyer belt 131. The electrode plates 36*a* form a comb-shape. The ground plates 36*b* also form a comb-shape. These combs face each other in the width direction of the conveyer belt 131 in such a manner that a tooth of one comb comes into a gap between teeth of the other comb. The electrode plates 136*a* are exposed at the right end of the conveyer belt 131 to form the terminals 136*a*'. The ground plates 136*b* are exposed at the left end of the conveyer belt 131 to form the terminals 136*b*'. The width of the terminals 136*a*' and 136*b*' is larger than that of the electrode plates 136*a* and the ground plates 136*b*. When these terminals come into contact with the conductive electrical-feeding brush 152 (see FIG. 2), a positive or negative voltage is applied to the terminals 136*a*' of the electrode plates 136*a* from the high-voltage power supply (not shown). On the other hand, the terminals 136*b*' of the ground plates 136*b* are grounded.

Figure 4:
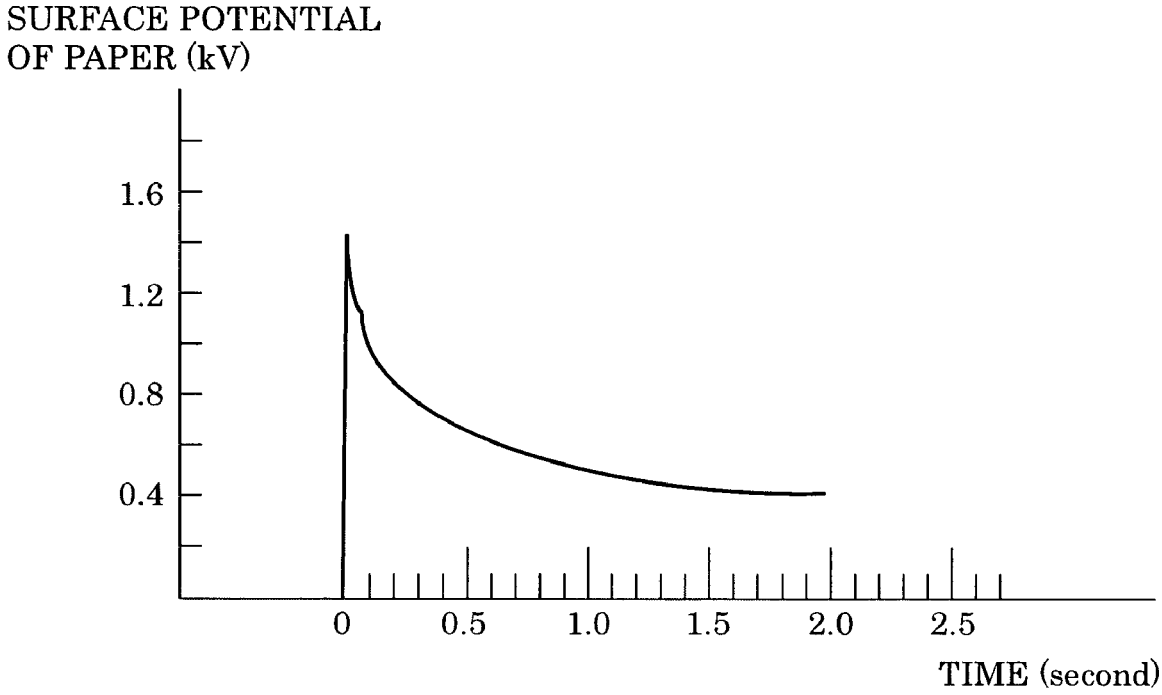
FIG. 4 shows change over time of surface potential generated on the surface of a recording medium fixed on a positive electrode plate.

When a voltage is applied to the electrode plates 136*a*, electrostatic force is generated in the direction of arrows in FIG. 9, thereby forming electrical lines of force. Due to the potential difference between the electrode plate 136*a* and the ground plate 136*b*, an electric field is generated above the electrode plate 136*a* and the ground plate 136*b*, and the recording medium P on the conveyer belt 131 is attracted and fastened to the conveyer belt 131. In addition, on the surface of the recording medium P, charges (surface potential) are generated. The charges have the same polarity as the voltage applied to the electrode plate 136*a*. The attracting force generated above the electrodes is smallest in the region between the electrode plate 136*a* and the ground plate 136*b* where there is no conductive metal. The ink mist suspending above the recording medium P is also attracted by the charges generated on the surface of the recording medium P. FIG. 4 shows change over time of surface potential generated on the surface of a recording medium fixed on a positive electrode plate (1.5 kV). As shown in FIG. 4, the surface potential of the recording medium P on the electrode plate is at high potential for a while after the voltage is applied. Therefore, the recording medium P is electrically charged, and the ink mist is oppositely charged. Consequently, the ink mist tends to adhere to the recording medium P.

Application of liquid different from ink to the surface of the recording medium reduces the amount of the ink mist adhering to the part to which the liquid is applied and its vicinities. The liquid (hereinafter referred to as processing liquid) does not include color material. The fact is because permeation of solvent, such as water, included in the processing liquid to the surface of the recording medium reduces the surface resistance of the recording medium and consequently reduces the surface charges.

Figure 5:
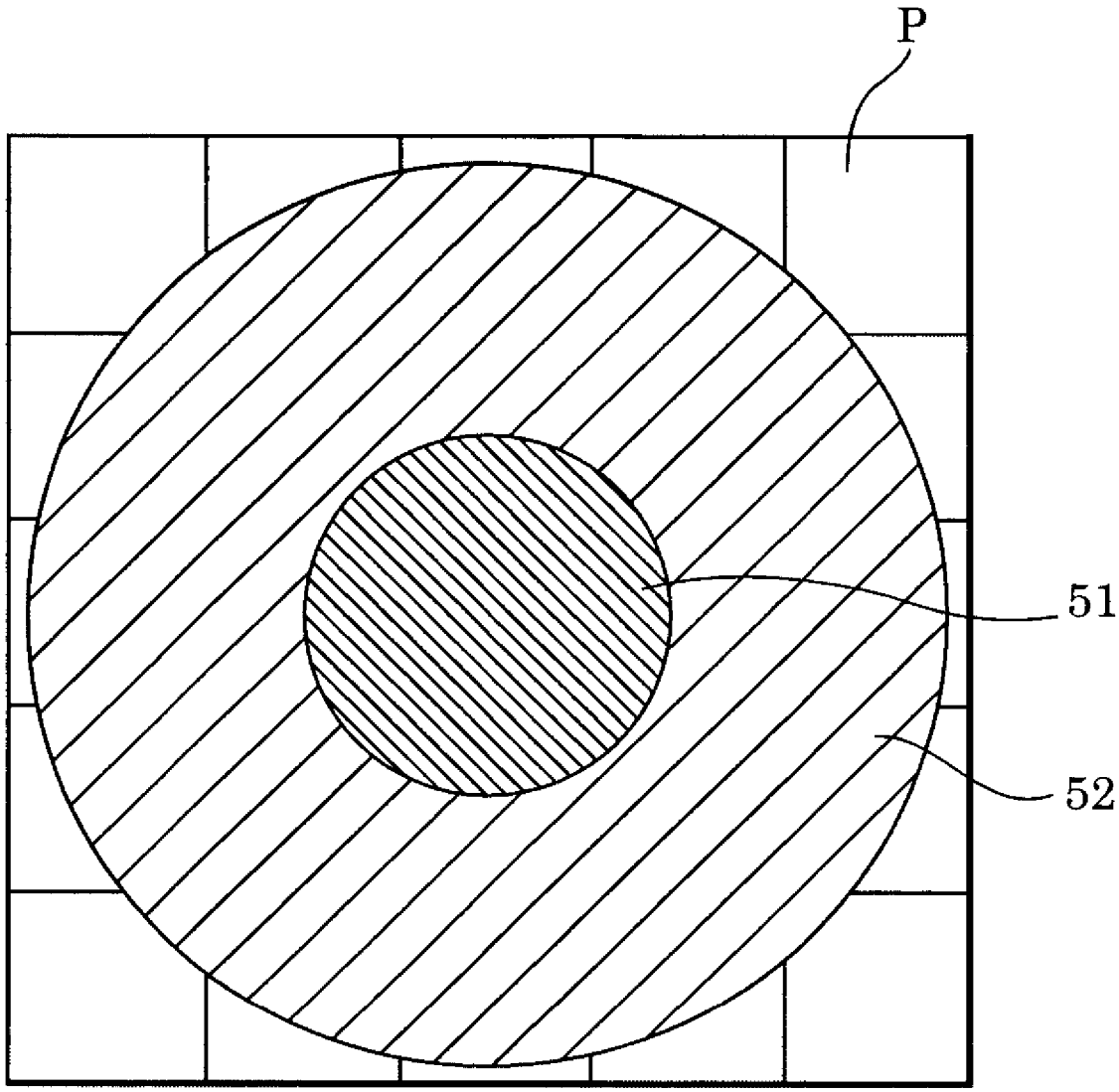
FIG. 5 is a schematic view showing extension of color material and solvent of ink on the recording medium.

FIG. 5 is a schematic view showing extension of color material and solvent of ink on the recording medium. In FIG. 5, the central left shaded region 51 shows the region where color material, such as dye, in ink permeates; and the right shaded region 52 shows the region where solvent in ink permeates. In the region 52, moisture included in the solvent reduces the surface charges of the recording medium P as described above. Since adhesion of the ink mist is reduced in this region, providing such a region by applying the processing liquid can reduce the amount of ink mist adhering to the recording medium P.

The discharging duty of the processing liquid to form this region, that is to say, the discharging rate of the processing liquid is as follows. Although the region where the solvent permeates depends on the rate of absorption of the recording medium P, the region where the solvent permeates is wide. Therefore, the processing liquid can be discharged in a low density. For example, in the case where 4 pl of the processing liquid is discharged at a recording resolution of 1200 dpi by 1200 dpi to plain paper, the necessary density is at least one drop per 5 pixels by 5 pixels (one pixel is a region of 1/1200 inch by 1/1200 inch), as shown in FIG. 5. In this case, the discharging duty of the processing liquid is 4(=1÷25×100) %. In fact, it is confirmed that the ink mist hardly adheres to the recording medium even in the case of one drop per 10 pixels by 10 pixels, that is to say, even in the case where the discharging duty is 1(=1÷100×100)%. Such a discharging duty of the processing liquid can be predetermined through experiment.

As described above, discharging the processing liquid from the liquid discharging head can neutralize the charges on the surface of the recording medium, and consequently can reduce adhesion of the ink mist to the recording medium to prevent deterioration of the quality of the image.

Embodiment 1

Figure 6:
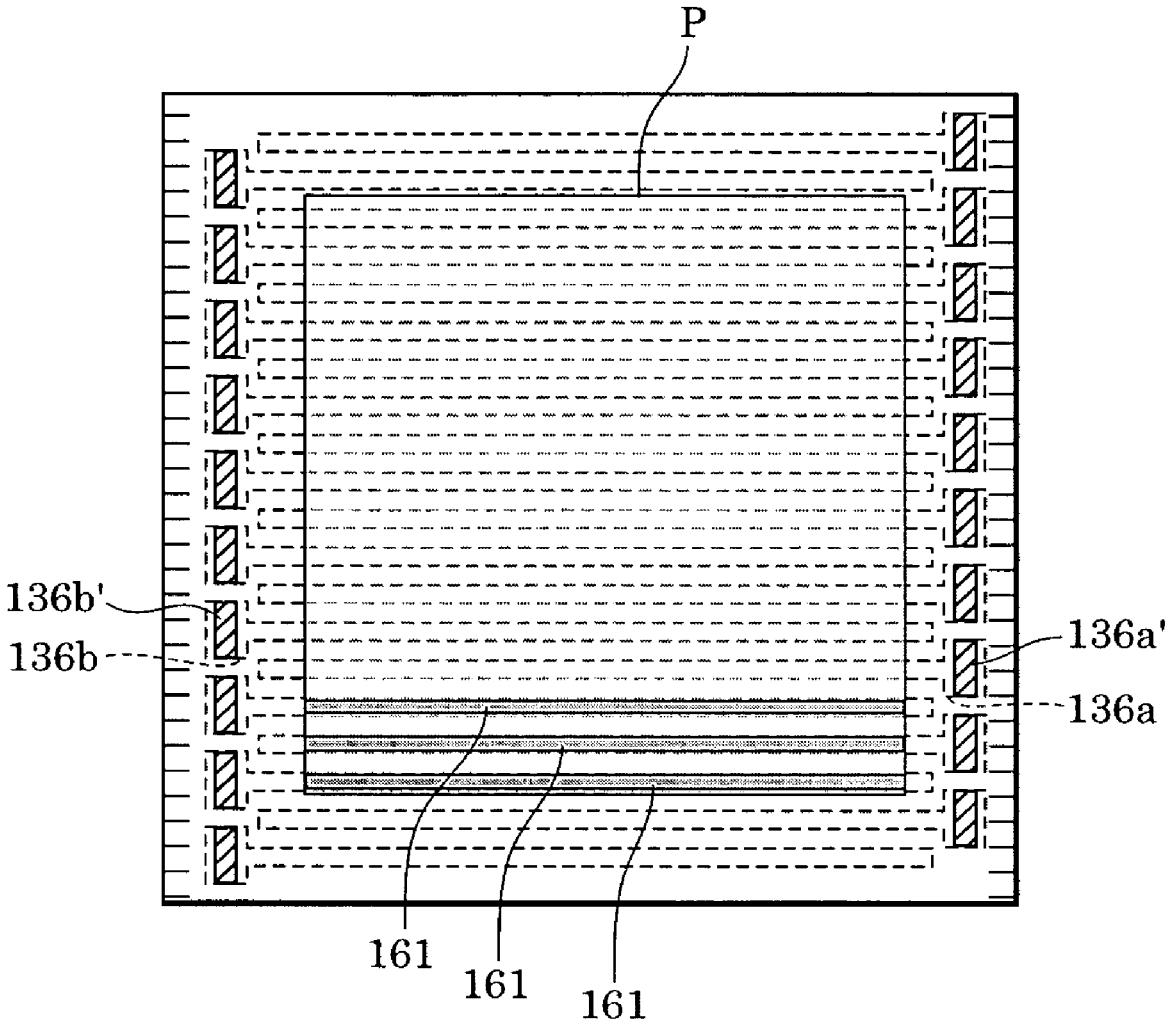
FIG. 6 illustrates the regions where processing liquid is discharged to the recording medium on the conveyer belt according to a first embodiment of the present invention.

FIG. 6 illustrates the regions where the processing liquid is discharged to the recording medium on the conveyer belt according to a first embodiment of the present invention.

In this embodiment, when black, cyan, magenta, and yellow inks are discharged to record an image, the processing liquid is discharged to predetermined positions that are determined independently of the positions on the recording medium P to which the ink is discharged. More specifically, the processing liquid is discharged to the regions 161 on the recording medium P. The regions 161 correspond to the electrode plates 136*a* and the ground plates 136*b* arranged alternately. In these regions 161, the force exerted by the electric field generated for the electrostatic attraction is strong, and there are a large number of surface charges. Therefore, the ink mist tends to adhere to these regions 161. In order to reduce the surface charges in the regions 161, the processing liquid is applied to the regions 161 before the ink is applied. Since the ink is applied after the surface charges in the regions 161 are reduced, the amount of the ink mist adhering to the regions 161 can be reduced. As described above, the ink mist is generated when the ink is discharged. Consequently, the amount of the ink mist adhering to the recording medium P can be reduced.

As described above, this embodiment discharges the processing liquid to the above regions 161 in advance. More specifically, the processing liquid is discharged to the regions 161 on the recording medium P as shown in FIG. 6 before the cyan, magenta, and yellow inks are discharged. Although the discharging duty of the processing liquid can be determined as described above with reference to FIG. 5, the processing liquid may be discharged to the regions 161, for example, at 100% duty.

The position of the regions 161 on the recording medium P can be detected, for example, as follows. Just to the right of the holding roller 140 in FIG. 2, an optical sensor is provided. The optical sensor detects the recording medium P. In addition, another sensor is provided along the conveyer belt 131. The sensor detects the electrode plates and the ground plates in the conveyer belt 131. Based on the detection results of these sensors, positional relationship between the recording medium P and the electrode plates and the ground plates in the conveyer belt 131 is detected. Based on this positional relationship, the regions 161 on the recording medium P can be determined. As described above, the processing liquid is discharged to the regions 161.

This embodiment can reduce the charges in the region where there are a large number of surface charges on the recording medium P. Consequently, this embodiment can prevent the deterioration of the quality of the image due to adhesion of the ink mist to the recording medium P.

Embodiment 2

Figure 7:
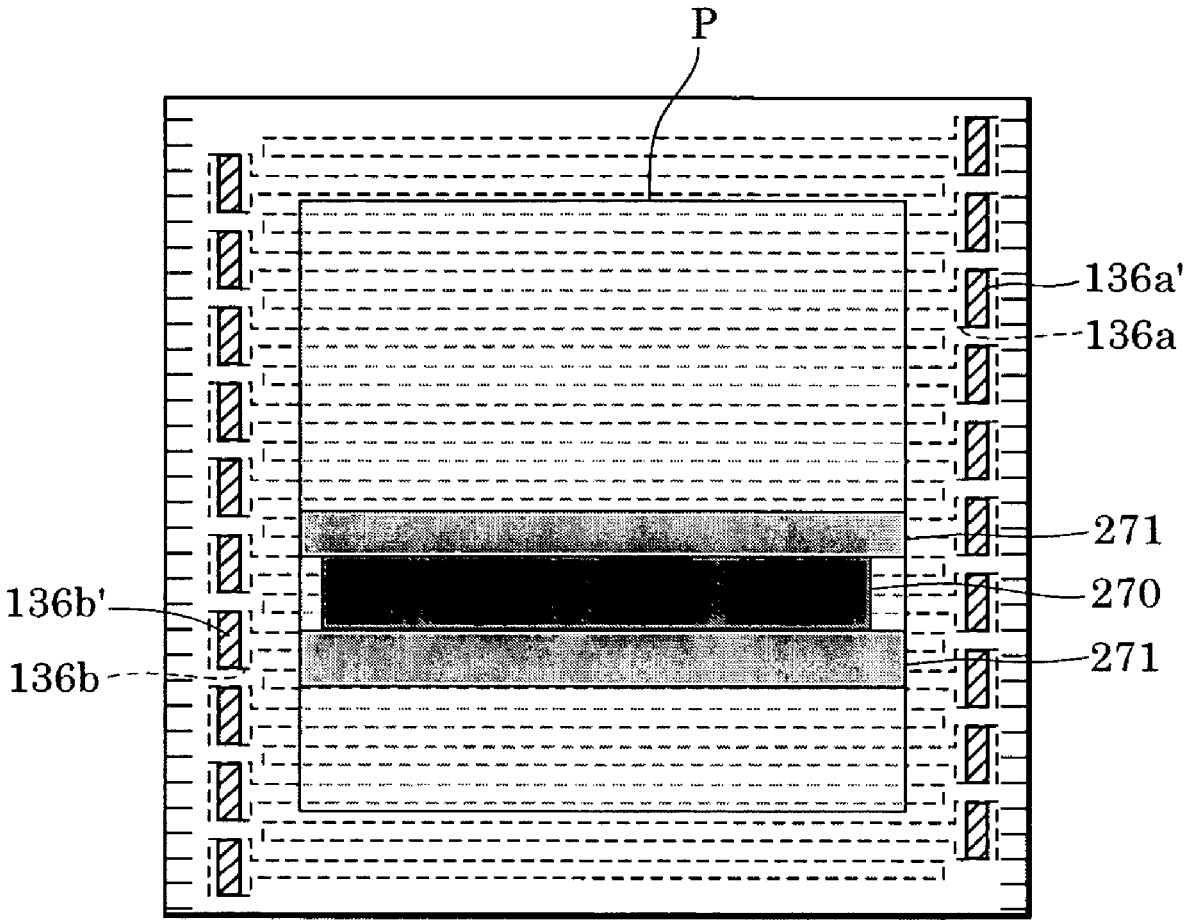
FIG. 7 illustrates the regions where processing liquid is discharged to the recording medium on the conveyer belt according to a second embodiment of the present invention.

FIG. 7 illustrates the regions where the processing liquid is discharged to the recording medium on the conveyer belt according to a second embodiment of the present invention.

A large amount of ink mist is generated when an image of a high recording duty is recorded. Therefore, as shown in FIG. 7, this embodiment discharges the processing liquid to the regions 271 adjacent to the image 270 recorded at the recording duty higher than a predetermined duty.

The reason why the processing liquid is discharged to the regions 271 adjacent to the high duty part 270 is as follows. That is to say, since the high duty part is provided with a lot of ink, the part has few surface charges. Therefore, there is no need to discharge the processing liquid to this part. However, a lot of mist is generated in the high duty part. This mist tends to adhere to the regions that are located in the vicinity of the high duty part and have a large number of surface charges. For example, in the case where no images are recorded immediately in front of or behind the high duty part, comparatively many surface charges remain in the regions. The mist tends to adhere to the regions. Therefore, this embodiment discharges the processing liquid to the regions 271 to which the mist tends to adhere so as to reduce the mist adhesion to these regions.

Of course, the position of these regions 271 can be detected based on the recording data. The predetermined duty is a standard for determining whether a recording duty is high or low. The predetermined duty can be obtained in advance by experiment. In the experiment, the status of generated mist and the amount of adhering mist are confirmed.

In this embodiment described above, the regions to which the processing liquid is discharged are limited to the regions where a lot of ink mist is generated. Therefore, this embodiment can save the processing liquid.

Embodiment 3

Figure 8:
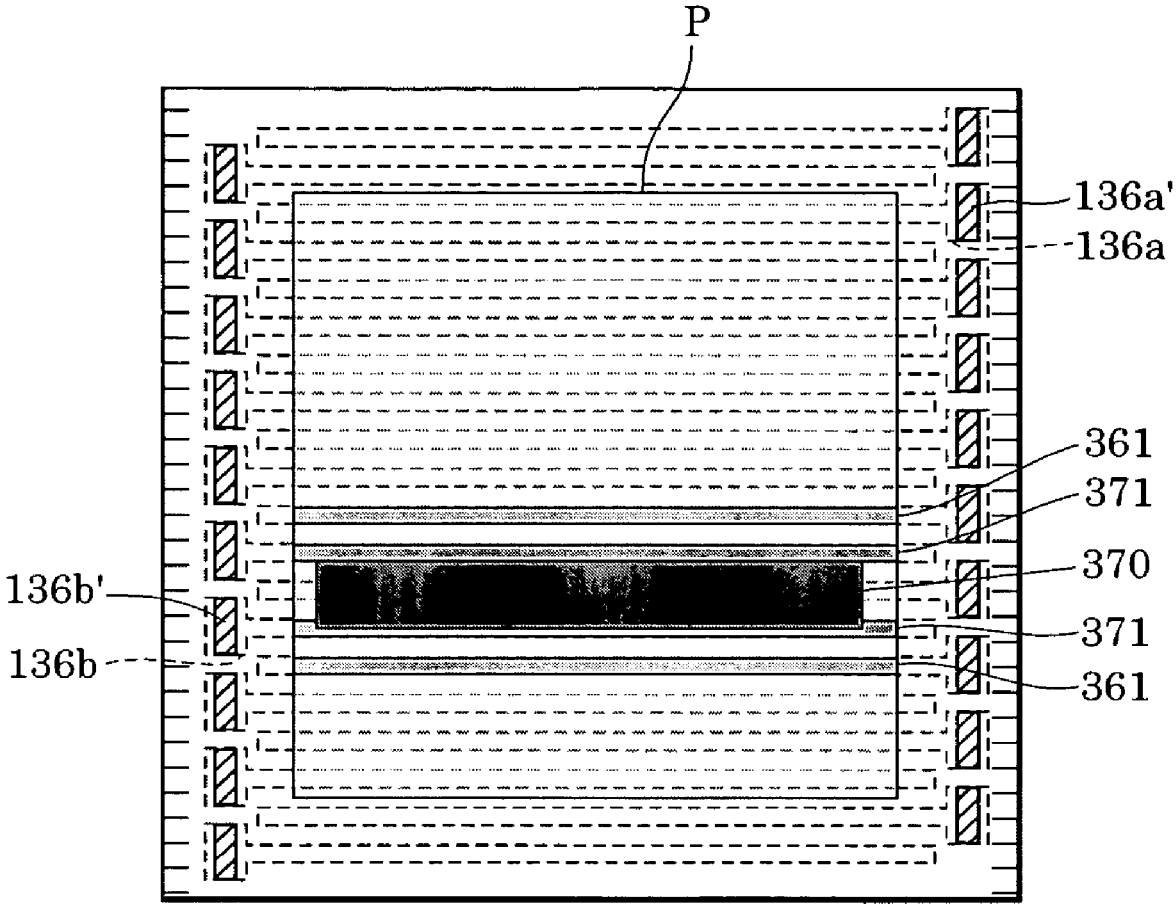
FIG. 8 illustrates the regions where processing liquid is discharged to the recording medium on the conveyer belt according to a third embodiment of the present invention.

FIG. 8 illustrates the regions where the processing liquid is discharged to the recording medium on the conveyer belt according to a third embodiment of the present invention.

This embodiment is a combination of embodiment 1 and embodiment 2. As described above, the ink mist tends to adhere to the vicinities of the electrode plates and the ground plates. In addition, a lot of ink mist is generated when an image at high recording duty is recorded. Therefore, as shown in FIG. 8, the processing liquid is discharged to the regions 371 adjacent to the high duty image 370, and is also discharged to the regions 361 corresponding to the electrode plates 136*a* and the ground plates 136*b*.

Embodiment 4

As in the above embodiments, this embodiment also discharges the processing liquid to a position determined independently of the position on the recording medium P to which black, cyan, magenta, and yellow inks are discharged. Although the above-described embodiments discharge the processing liquid to specific regions, the processing liquid may be discharged to all regions on the recording medium P to which the liquid discharging head 85S can discharge the processing liquid. In this case, the processing liquid can be discharged to reduce the surface charges without detecting the positions on the recording medium P corresponding to the electrode plates and the ground plates and without detecting the regions adjacent to the high-duty recording region.

In this embodiment, the discharging duty may be 100%. Considering the permeation of the inks discharged to the recording medium P, however, a smaller duty is preferable. The discharging duty in this case can be determined as described above with reference to FIG. 5. Alternatively, the discharging duty of the processing liquid may be determined according to the ability of the recording medium P to absorb liquid.

Embodiment 5

In the above embodiments, the processing liquid is discharged after black ink is discharged and before cyan, magenta, and yellow inks are discharged. However, the present invention is not limited to this order. The processing liquid may be discharged before black ink is discharged, that is to say, before any ink is discharged. Alternatively, the processing liquid may be discharged between the discharge of cyan ink and the discharge of magenta ink. The point is to prevent the mist from adhering to the recording medium P to some extent. The amount of the ink mist adhering to the surface of the recording medium can be reduced by applying the processing liquid before the suspending ink mist adheres to the recording medium and consequently reducing the charges that are generated on the surface of the recording medium due to the electric field for electrostatic attraction and have opposite polarity from the ink mist.

Embodiment 6

Concerning how to apply the processing liquid, although the processing liquid is discharged from a liquid discharging head in the above embodiments 1 to 5, the processing liquid may be applied with a roller. In this case, the processing liquid can be applied with a roller to the overall surface of the recording medium P before any ink is discharged from the recording head.

Other Embodiments

In the above embodiments, liquid reacting with black ink is used as the processing liquid. However, the present invention is not limited to this. The processing liquid may be liquid reacting with color inks (cyan ink, magenta ink, and yellow ink). Alternatively, the processing liquid may be liquid reacting with both black ink and color inks.

Alternatively, the processing liquid may be liquid not reacting with ink. For example, the processing liquid may be clear ink, which is ink not including color material. Alternatively, the processing liquid may be water.

In the above embodiments, one comb electrode is composed of the electrode plates 136*a*, and the other comb electrode is composed of the ground plates 136*b*. However, the present invention is not limited to this. Instead of the ground plates 136*b*, electrode plates 136*a* may be provided. That is to say, both of the comb electrodes may be composed of electrode plates 136*a*. In this case, a positive voltage is applied to one comb electrode, and a negative voltage is applied to the other comb electrode in order to generate potential difference on the conveyer belt.

While the present invention has been described with reference to exemplary embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application Nos. 2003-417370 filed Dec. 15, 2003 and 2004-296683 filed Oct. 8, 2004, which are hereby incorporated by reference herein.

What is claimed is:

1. An ink jet recording apparatus operable to record images on a recording medium with ink, the ink jet recording apparatus comprising:

a conveyer belt operable to convey the recording medium thereon;

an attracting-force generating device including an electrode plate provided on the conveyor belt and operable to generate a force to attract the recording medium to the conveyer belt;

a recording head operable to discharge the ink onto the recording medium to record images thereon;

a liquid applying device applying a liquid different from the ink to at least a position on the recording medium corresponding to the attracting-force generating device, wherein the liquid applying device applies the liquid to the recording medium before the recording head discharges the ink onto the recording medium, wherein the liquid applying device includes a liquid discharging head having a discharging nozzle configured to discharge the liquid therefrom;

a position detecting device configured to detect the position on the recording medium corresponding to the attracting-force generating device; and a controlling device controlling the liquid discharging head to discharge the liquid at the position.

2. An ink jet recording apparatus according to claim 1, wherein the recording head is operable to discharge a plurality of inks, and wherein the liquid applying device applies the liquid to the recording medium before the recording head discharges any one of the plurality of inks onto the recording medium.

3. An ink jet recording apparatus according to claim 2, wherein the plurality of inks includes at least a first ink and a second ink, and wherein the liquid applying device applies the liquid to the position on the recording medium before the recording head discharges the first and second inks onto the position on the recording medium.

4. An ink jet recording apparatus according to claim 2, wherein the plurality of inks includes at least a first ink and a second ink, and wherein the liquid applying device applies the liquid to the position on the recording medium after the recording head discharges the first ink onto the position and before the recording head discharges the second ink onto the position.

5. An ink jet recording apparatus according to claim 1, further comprising:

a duty detecting device detecting a recording duty of regions on the recording medium based on recording data; and a second controlling device controlling the liquid discharging head to discharge the liquid to a region on the recording medium adjacent to a region on the recording medium having a recording duty higher than a predetermined duty value.

6. An ink jet recording apparatus operable to record images on a recording medium with ink, the ink jet recording apparatus comprising:

a conveyer belt operable to convey the recording medium thereon;

a recording head operable to discharge the ink onto the recording medium to record images thereon;

a liquid discharging head configured to discharge a liquid different from the ink onto the recording medium;

a duty detecting device detecting a recording duty of regions on the recording medium based on recording data; and a controlling device controlling the liquid discharging head to discharge the liquid to a region on the recording medium adjacent to a region on the recording medium having a recording duty higher than a predetermined duty value.

* * * * *